US005105120A

United States Patent [19]

Nishioka et al.

[11] Patent Number: 5,105,120

[45] Date of Patent: Apr. 14, 1992

[54] DEFLECTION YOKE HAVING A FERRITE-CONTAINING PLASTIC COMPOSITION

[75] Inventors: Katsunori Nishioka; Shouiti Yoshiyama; Akira Naito, all of Sagamihara, Japan

[73] Assignee: Mitsubishi Denki Kabushiki Kaisha, Tokyo, Japan

[21] Appl. No.: 552,053

[22] Filed: Jul. 13, 1990

[30] Foreign Application Priority Data

Aug. 1, 1989 [JP] Japan ..... 1-199651
Aug. 21, 1989 [JP] Japan ..... 1-214357

[51] Int. Cl.[5] ..... H01J 29/70
[52] U.S. Cl. ..... 313/440; 335/210
[58] Field of Search ..... 313/440; 335/210; 358/248, 249; 252/513, 519; 524/403, 431, 435

[56] References Cited

U.S. PATENT DOCUMENTS

| | | | |
|---|---|---|---|
| 4,390.458 | 6/1983 | McKaveney | 252/519 X |
| 4,502,982 | 3/1985 | Horie et al. | 252/513 |
| 4,690,778 | 9/1987 | Narumiya et al. | 524/435 X |
| 4,776,979 | 10/1988 | Kageyama | 252/513 X |
| 4,783,279 | 11/1988 | Petermann et al. | 252/513 X |
| 4,814,018 | 3/1989 | Tsurmaru et al. | 524/431 X |
| 4,841,267 | 6/1989 | Watabe et al. | 335/210 |

OTHER PUBLICATIONS

Ferrite, Nov. 30, 1986, Maruzen K. K., pp. 142–145.

*Primary Examiner*—Donald J. Yusko
*Assistant Examiner*—Ashok Patel
*Attorney, Agent, or Firm*—Oblon, Spivak, McClelland, Maier & Neustadt

[57] ABSTRACT

A ferrite-containing plastic composition including a ferrite powder having an average particle size of from 100 to 500 μm in an amount of at least 80% by weight based on the entire composition, a plastic and a small amount of additives.

4 Claims, 2 Drawing Sheets

DEFLECTION YOKE HAVING A FERRITE-CONTAINING PLASTIC COMPOSITION

BACKGROUND OF THE INVENTION

1. Field of the Invention

The present invention relates to a ferrite-containing plastic composition useful for forming anti-noise parts which are used for removing noises for various electronic appliances. The present invention also relates to a deflection yoke made of such a composition, particularly a deflection yoke useful for an image receiving tube which can be used for televisions or display monitors.

2. Discussion of Background

FIG. 2 is a perspective view of a conventional ferrite bead useful for removing high frequency noises.

In the Figure, reference numeral 4 designates a ferrite bead formed of a ferrite-containing plastic composition, numeral 2 is a through-hole, and numeral 3 is a lead wire passing through the through-hole 2.

With this structure, the ferrite bead 4 portion has an impedance in a high frequency region and provides a function to absorb and attenuate high frequency noises.

With such a conventional ferrite bead formed of a ferrite-containing plastic composition, the particle size of the ferrite particles contained is small, and the ferrite content is low, whereby the function to absorb and attenuate the high frequency noises is rather limited, and an effective attenuation effect can not be obtained. In order to increase the attenuation effect, the shape is obliged to be enlarged.

However, if the particle size of the ferrite particles is increased too much in order to increase the attenuation effect, the moldability and processability which are characteristic features of the plastic ferrite will be lost.

It is an object of the present invention to overcome such problems and to provide a ferrite-containing plastic composition which is capable of effectively removing high frequency noises and which, at the same time, provides the desired moldability and processability characteristic to a plastic ferrite (a ferrite-containing plastic composition).

With respect to a deflection yoke, an apparatus as illustrated in FIGS. 5 to 7 has been known. In these Figures, reference numeral 11 designates a deflection yoke, numeral 12 indicates an image receiving tube having such a deflection yoke mounted thereon, and numeral 13 is the main body of the deflection yoke 11, which is a sintered ferrite core made of a sintered ferrite material. Numeral 14 indicates a deflecting coil, and numeral 15 indicates a separator. The deflection yoke 11 is constituted by the yoke main body 13, the deflecting coil 14, a substrate (not shown), etc. As shown in FIG. 7, it is used as attached to the neck portion of the image receiving tube 12. Numeral 16 indicates grooves for winding.

The deflecting coil 14 of the image receiving tube 12 comprises two sets of vertical and horizontal coils. When saw tooth currents for vertical and horizontal scanning are conducted thereto, an electron beam will be deflected up and down, and left and right, so that a raster will be depicted on the image receiving tube 12.

The conventional deflection yoke was formed of a sintered ferrite material and tends to undergo shrinkage after the sintering. Accordingly, it was required to improve the processing precision by conducting e.g. milling after sintering in order to improve the precision of e.g. grooves 16 for winding.

Further, with a deflection yoke, the precision of the video image depends largely on the magnetic flux density distribution of the deflecting magnetic field, and the distribution of the deflecting magnetic field is determined by the winding shape and the winding density distribution of the deflecting coils. Accordingly, in order to improve the precision of the video image, it is necessary to provide grooves 16 for winding to improve the winding precision with respect to the yoke body 3 as shown in FIG. 3, and the processing precision is required for forming the grooves 16 for winding. For this reason, it was difficult to produce highly precise deflection yokes in a large quantity, and there was a problem that the production cost tended to be high.

Accordingly, it is another object of the present invention to overcome such problems and to provide an inexpensive deflection yoke having a high deflecting precision using a plastic ferrite comprising a ferrite powder, a plastic and a small amount of additives, by improving the moldability and the processing precision and eliminating the necessity for processing after sintering.

SUMMARY OF THE INVENTION

Thus, according to the first aspect, the present invention provides a ferrite-containing plastic composition comprising a ferrite powder having an average particle size of from 100 to 500 μm in an amount of at least 80% by weight based on the entire composition, a plastic, and a small amount of additives.

According to the second aspect, the present invention provides a ferrite-containing plastic composition comprising a ferrite powder of large particle size having an average particle size of from 100 μm to 2 mm in an amount of at least 50% by weight based on the entire composition, a ferrite powder of small particle size filling spaces in said ferrite powder of large particle size, a plastic, and a small amount of additives.

According to the third aspect, the present invention provides a deflection yoke composed at least partly of a ferrite-containing plastic composition comprising a ferrite powder of large particle size having an average particle size of from 100 μm to 2 mm in an amount of at least 50% by weight based on the entire composition, a ferrite powder of small particle size filling spaces in said ferrite powder of large particle size, a plastic and a small amount of additives.

According to the first and second aspects of the present invention, the magnetic properties similar to a sintered ferrite body can be obtained, and the packing density can be made large, whereby the moldability and the processability as a plastic ferrite can be maintained.

According to the third aspect of the present invention, the deflection yoke is composed at least partly of a plastic ferrite material, whereby the moldability can be improved, the deflecting precision of the deflection yoke can be made excellent, and the mass productivity can be improved.

DETAILED DESCRIPTION OF THE PREFERRED EMBODIMENTS

Now, the present invention will be described in detail with reference to the preferred embodiments.

Figure 1:
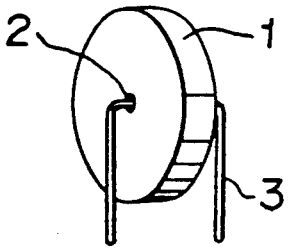
FIG. 1 is a perspective view of a ferrite bead molded with the composition of the first Example of the present invention.
Figure 2:
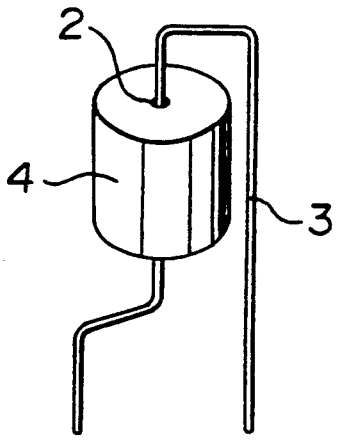
FIG. 2 is a perspective view of a conventional ferrite bead.

FIG. 1 is a perspective view of a ferrite bead for removing high frequency noises, which is formed with a "ferrite-containing plastic composition" of the first Example of the present invention.

In the Figure, reference numeral 1 is a molded product (a ferrite bead) having an outer diameter of 10 mm and a thickness of 3 mm made of the ferrite-containing plastic composition of the first Example. A through-hole 2 having a diameter of 0.5 mm is provided at its center. A lead conductor 3 having a diameter of 0.3 mm is passed through the through-hole 2. The terminal of this lead wire was connected to a measuring device, and the permeability and the attenuation characteristics of the molded product in a high frequency region were measured, and the results are shown in Table 1 given hereinafter.

Now, preparation of this molded product will be described.

Calcined soft ferrite of nickel-zinc system, was pulverized, and a small amount of an aqueous PVA (polyvinyl alcohol) solution was added thereto, and granules were prepared. The granules were sintered to obtain sintered ferrite particles. The particles were classified to obtain ferrite powders having different particle sizes. Taking the particle sizes and the contents of these ferrite powders into consideration, the ferrite powders and a binder plastic were weighed. The weighed plastic was dissolved in a suitable solvent, and the weighed ferrite powders were stirred and mixed thereto. Then, the solvent was evaporated to obtain a soft ferrite powder coated with the plastic. The powder was molded by a dry powder pressing method to obtain the above mentioned molded product having an outer diameter of 10 mm and a thickness of 3 mm. A hole having a diameter of 0.5 mm was formed at its center, to obtain a molded product for testing.

Then, as shown in FIG. 1, a lead wire 3 was passed through, and the permeability and the attenuation characteristics of the molded product were measured. The main items of the measured results are shown in the following Table 1.

TABLE 1

| | Properties of the ferrite-containing plastic molded product | | | | | | | | |
|---|---|---|---|---|---|---|---|---|---|
| | | | | | | Attenuation (−dB) | | | |
| No. | Ferrite particle size composition | Ferrite content | Permeability 1 MHz | 10 MHz | 100 MHz | 10 MHz | 100 MHz | Attenuation peak value | Moldability Processability |
| 1 | 2000–1800 μm 72 wt parts<br>340–220 μm 14 wt parts<br>56–24 μm 10 wt parts<br>10–1 μm 4 wt parts | 95 wt % | 75 | 63 | 42 | 0.2 | 1.15 | 1.2<br>(80 MHz) | Δ |
| 2 | 1000–500 μm | 95 wt % | 70 | 60 | 41 | 0.2 | 1.05 | 1.1<br>(80 MHz) | Δ |
| 3 | 500–100 μm | 95 wt % | 61 | 57 | 40 | 0.15 | 0.95 | 1.0<br>(90 MHz) | ○ |
| 4 | 60–40 μm 72 wt parts<br>9–5 μm 14 wt parts<br>3– μm 14 wt parts | 95 wt % | 37 | 36 | 30 | 0.05 | 0.4 | 0.5<br>(130 MHz) | ○ |

As shown in Table 1, if the particle size of the soft ferrite exceeds 500 μm, the moldability and the processability tend to be poor, whereby the characteristic features of the plastic ferrite will be lost. On the other hand, if the particle size is smaller than 100 μm, the permeability and the attenuation tend to be poor.

Now, the second Example of the present invention i.e. a "ferrite-containing plastic composition" comprising a soft ferrite powder of large particle size and a few soft ferrite powders of small particle sizes filling the spaces of the large particles, will be described.

In the same manner as shown in FIG. 1, a ferrite bead was molded from the composition of this Example, and the permeability and the attenuation characteristics of the ferrite bead in a high frequency region were measured, and the results are shown in the following Table 2.

Preparation of the molded product was the same as in the first Example except for the selection of the particle sizes of the soft ferrite powders.

The main items of the measured results of the molded product having a lead wire passed therethrough, are shown in the following Table 2.

TABLE 2

| | Properties of the ferrite-containing plastic molded product | | | | | | | |
|---|---|---|---|---|---|---|---|---|
| | | | | | | Attenuation (−dB) | | |
| No. | Ferrite particle size composition | Ferrite content | Permeability 1 MHz | 10 MHz | 100 MHz | 10 MHz | 100 MHz | Attenuation peak value |
| 1 | 2000–1800 μm 72 wt parts<br>340–220 μm 14 wt parts<br>56–24 μm 10 wt parts<br>10–1 μm 4 wt parts | 95 wt % | 75 | 63 | 42 | 0.2 | 1.15 | 1.2<br>(80 MHz) |
| 2 | 600–400 μm 65 wt parts<br>85–55 μm 18 wt parts | 80 wt % | 56 | 52 | 40 | 0.1 | 0.9 | 0.95<br>(80 MHz) |

TABLE 2-continued

| No. | Ferrite particle size composition | Ferrite content | Properties of the ferrite-containing plastic molded product: Permeability 1 MHz | Permeability 10 MHz | Permeability 100 MHz | Attenuation (−dB) 10 MHz | Attenuation (−dB) 100 MHz | Attenuation (−dB) Attenuation peak value |
|---|---|---|---|---|---|---|---|---|
| | 14–6 μm 12 wt parts<br>3–1 μm 5 wt parts | | | | | | | |
| 3 | 120–80 μm 55 wt parts<br>17–10 μm 35 wt parts<br>3– μm 10 wt parts | 80 wt % | 51 | 49 | 38 | 0.1 | 0.8 | 0.7<br>(110 MHz) |
| 4 | 120–80 μm 40 wt parts<br>17–10 μm 50 wt parts<br>3– μm 10 wt parts | 80 wt % | 41 | 38 | 33 | 0.05 | 0.5 | 0.55<br>(140 MHz) |
| 5 | 60–40 μm 72 wt parts<br>9–5 μm 14 wt parts<br>3– 14 wt parts | 95 wt % | 37 | 36 | 30 | 0.05 | 0.4 | 0.5<br>(140 MHz) |

As shown in Table 2, the permeability and the attenuation of the molded product are large when in the particle size distribution of the soft ferrite particles, the main powder of the largest particle size has a particle size of at least 100 μm, and it constitutes at least about 50% by weight in the total ferrite, and the content of the total ferrite in the composition is at least 80% by weight.

In this case, the moldability and the processability as the plastic ferrite will not be lost.

The plastic useful for the present invention can be selected from a wide range including thermoplastic nylons, PE (polyethylene), PP (polypropylene), PS (polystyrene), acrylate resins and polyester resins, and thermostetting epoxy resins and phenol resins. The additives useful in the present invention, include a coupling agent to improve the bond between the ferrite powder and the plastic, a releasing agent to improve the release from the mold, and a lubricant. The molding density can be improved by making the shape of the soft ferrite particles spherical. For the molding, various molding methods including injection molding, extrusion molding and transfer molding, may be employed in addition to the above mentioned powder pressing method.

The application of the composition of the present invention was described with respect to the case of a ferrite bead. Other applications include casings utilizing the electromagnetic shielding effects, and choke coils for noise filter. Further, in the field of using non-magnetic resins in ferrite-applied parts for e.g. transformers, high efficiency can be attained by molding a shaped product from the composition of the present invention.

As described in the foregoing, according to the first and second aspects of the present invention, it is possible to obtain ferrite-containing plastic compositions having magnetic properties capable of effectively removing high frequency noises, while maintaining the moldability and the processability as a plastic ferrite, by controlling the range of the average particle size and the distribution of the soft ferrite particles and the ferrite content for the ferrite-containing plastic composition.

Now, the third aspect of the present invention will be described with reference to the drawings.

Figure 3:
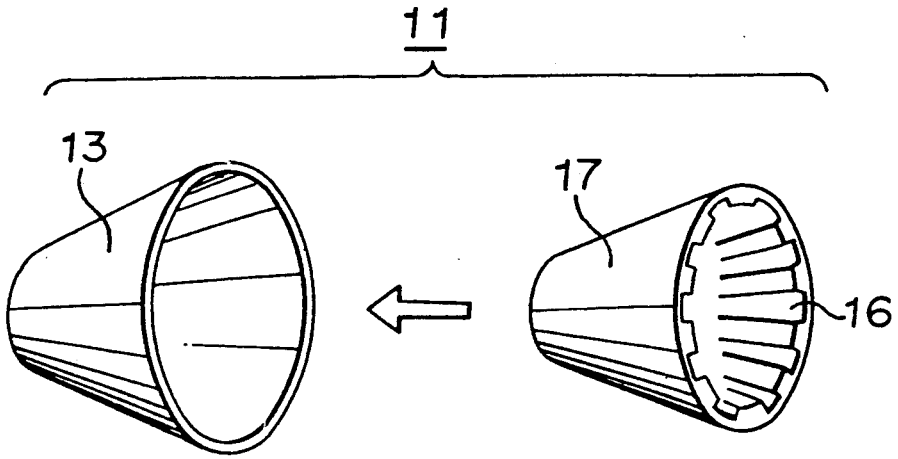
FIG. 3 perspective view illustrating a deflection yoke according to one embodiment of the present invention.
Figure 5:
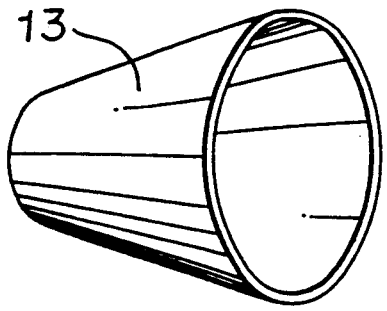
FIG. 5 is a perspective view illustrating a conventional deflection yoke.
Figure 6:
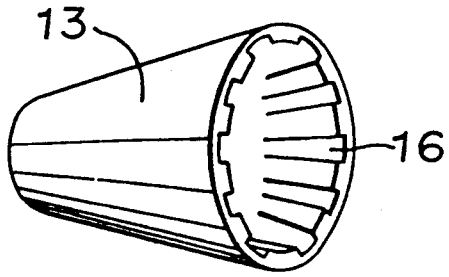
FIG. 6 is a perspective view illustrating a case where grooves for winding are provided.
Figure 7:
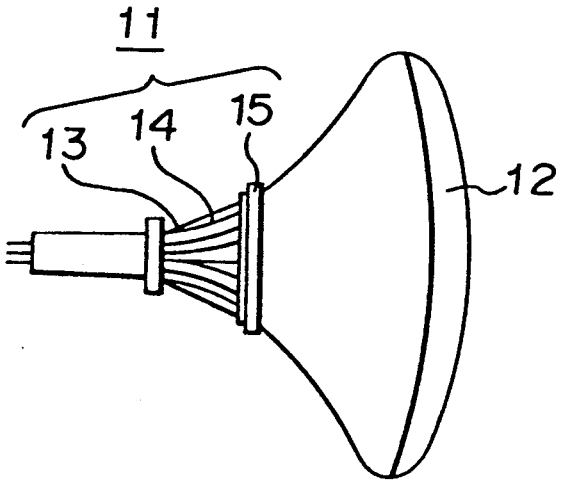
FIG. 7 is a perspective view illustrating an image receiving tube having the deflection yoke attached thereto.

FIG. 3 is a perspective view illustrating a deflection yoke according to one embodiment of the present invention. With respect to the same (or equivalent) constituting elements as in the conventional case illustrated in FIGS. 5 to 7, they will be identified with the same reference numerals, and their descriptions will be omitted. In FIG. 3, reference numeral 13 indicates the yoke main body, which is made of sintered ferrite. Numeral 17 designates a plastic ferrite core. This plastic ferrite core 17 is provided with grooves 16 for winding, and it constitutes a part of the deflection yoke. This embodiment illustrates a case wherein the plastic ferrite core 17 is a part made of a composition comprising a soft ferrite powder, a plastic and a small amount of additives, wherein the ferrite content is at least 80% by weight, a ferrite powder of large particle size has a particle size of at least 100 μm, and a ferrite powder of a small particle size has a particle size suitable for filling spaces of the large particles (hereinafter referred to simply as a plastic ferrite core). In this embodiment, a deflection yoke is constructed by combining the plastic ferrite core 17 provided with the grooves 16 for winding, to the yoke main body 13, as shown by an arrow.

In the above structure, the plastic ferrite core 17 provided with the winding portion, which constitutes at least a part of the deflection yoke, is made of a composition comprising the soft ferrite powder, the plastic and a small amount of additives, whereby a deflection yoke which can easily be magnetized with the magnetic field being readily attenuated, can be obtained, and highly precise grooves 16 for winding can be molded, which require no processing after molding. It is produced as a plastic molded product, whereby it can readily be prepared uniformly, and a product having a high precision can be obtained at a low cost.

The ferrite content of the above plastic ferrite part is at least 80% by weight, and the ferrite particle sizes are at least two different types, e.g. large particles have a particle size of at least 100 μm, and small particles have a particle size suitable for filling spaces of the large particles, whereby in the molded plastic ferrite core, spaces are filled with the particles of small particle size. Thus, as a molded product, it has a proper level of strength and density, and a product having a high dimensional precision can be obtained, so that it can readily be combined to the yoke main body 13. Thus, a deflection yoke having a high deflection precision can be constructed. Yet, uniform products can be produced at a low cost in a large quantity by molding.

As a ferrite sintered body of this type, a 100 wt % ferrite sintered body has good properties. Whereas, in this embodiment, ferrite powders having different particle sizes are employed, and a powder of small particle size is used to fill spaces of the large particles, whereby the spaces will be filled, and at the same time a product having good properties can be obtained.

As described in the foregoing, according to one embodiment of the present invention, the deflection yoke 11 is constructed by combining the plastic ferrite core 17 to the yoke main body 13, and by having the plastic ferrite core 17 as a part of the deflection yoke, it is possible to provide uniform mass-producible deflecting coils with an excellent deflection precision can be presented at a low cost.

Figure 4:
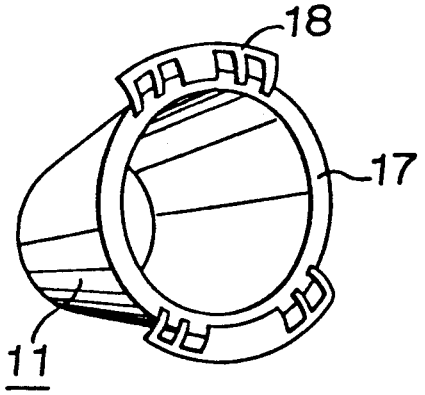
FIG. 4 is a perspective view illustrating a deflection yoke according to another embodiment of the present invention.

In the above embodiment, the plastic ferrite core 17 provided with grooves 16 for winding, is combined to the yoke main body 13. Whereas, in another embodiment as shown in FIG. 4, deflecting coils themselves are formed on a plastic ferrite core 17 at deflecting coil portions 18, so that the entire deflection yoke 11 is made of a plastic ferrite core 17 as a plastic ferrite part. With this structure, the number of process steps can be reduced, and a uniform deflection yoke 11 having excellent dimensional precision and deflecting precision can be produced at a low cost.

In the above embodiments, a ferrite powder composition comprising a soft ferrite powder, a plastic and a small amount of additives, is used as the plastic ferrite. However, as the plastic ferrite, a ferrite powder may be employed.

As described in the foregoing, according to the third aspect of the present invention, the deflection yoke is composed at least partly of a part made of a plastic ferrite comprising a ferrite powder, a plastic and a small amount of additives, wherein the ferrite content is at least 80% by weight, ferrite of large particle size has a particle size of at least 100 μm, and ferrite of small particle size has a particle size suitable for filling spaces of the large particles, whereby a mass-producible low cost deflection yoke having an excellent deflecting precision, can be obtained.

What is claimed is:

1. A deflection yoke composed at least partly of a ferrite-containing plastic composition comprising a ferrite powder of large particles size having an average particle size of from 100 μm to 2 mm in an amount of at least 50% by weight based on the entire composition, a ferrite powder of small particle size in an amount of less than 50% by weight based on the entire composition, filling spaces in said ferrite powder of large particle size, a plastic and a small amount of additives.

2. The deflection yoke according to claim 1, wherein the ferrite-containing plastic composition constitutes an inner wall of the deflection yoke, the inner wall has, on its surface, grooves for winding, and a sintered ferrite constituting an outer wall of the deflection yoke is provided on the rear side of this ferrite-containing plastic composition.

3. The deflection yoke according to claim 1, wherein the ferrite-containing plastic composition constitutes the entire deflection yoke and is provided internally with deflecting coils.

4. The deflection yoke according to claim 1, wherein the total ferrite powder content in the ferrite-containing plastic composition is at least 80% by weight.

* * * * *